US011767850B2

(12) United States Patent
Badr et al.

(10) Patent No.: US 11,767,850 B2
(45) Date of Patent: Sep. 26, 2023

(54) ELECTRICAL SUBMERSIBLE PUMP WITH LIQUID-GAS HOMOGENIZER

(71) Applicants: Saudi Arabian Oil Company, Dhahran (SA); King Fahd University of Petroleum and Minerals, Dhahran (SA)

(72) Inventors: Hassan Mohamed Badr, Dhahran (SA); Chidirim Enoch Ejim, Dhahran (SA); Jinjiang Xiao, Dhahran (SA); Abdelsalam Mohammad AlSarkhi, Dhahran (SA); Muhammad Mustafa Kamal, Dhahran (SA)

(73) Assignees: SAUDI ARABIAN OIL COMPANY, Dhahran (SA); KING FAHD UNIVERSITY OF PETROLEUM & MINERALS, Dhahran (SA)

( * ) Notice: Subject to any disclaimer, the term of this patent is extended or adjusted under 35 U.S.C. 154(b) by 455 days.

(21) Appl. No.: 16/786,386

(22) Filed: Feb. 10, 2020

(65) Prior Publication Data

US 2021/0246903 A1 Aug. 12, 2021

(51) Int. Cl.

| | |
|---|---|
| ***F04D 19/02*** | (2006.01) |
| ***F04D 25/06*** | (2006.01) |
| ***F04D 1/06*** | (2006.01) |
| ***F04D 13/10*** | (2006.01) |
| ***F04D 29/68*** | (2006.01) |
| ***F04D 29/24*** | (2006.01) |

(52) U.S. Cl.

CPC ..... *F04D 19/022* (2013.01); *F04D 1/06* (2013.01); *F04D 13/10* (2013.01); *F04D 25/0686* (2013.01); *F04D 29/245* (2013.01); *F04D 29/688* (2013.01)

(58) Field of Classification Search

CPC ..... F04D 19/022; F04D 1/06; F04D 13/10; F04D 25/0686; F04D 29/24; F04D 29/245; F04D 29/669; F04D 31/00

USPC ..... 416/181, 183, 231 R, 231 A, 231 B

See application file for complete search history.

(56) References Cited

U.S. PATENT DOCUMENTS

| | | | | |
|---|---|---|---|---|
| 4,890,980 | A * | 1/1990 | Heald | F04D 29/2277 416/183 |
| 5,628,616 | A * | 5/1997 | Lee | F04D 29/2288 415/199.1 |
| 6,106,224 | A | 8/2000 | Sheth et al. | |
| 6,893,207 | B2 | 5/2005 | Kao | |
| 7,326,034 | B2 | 2/2008 | Sheth et al. | |
| 7,343,967 | B1 | 3/2008 | Floyd | |

(Continued)

FOREIGN PATENT DOCUMENTS

| | | |
|---|---|---|
| WO | WO-2019/079070 A1 | 4/2019 |
| WO | WO-2021/161073 A1 | 8/2021 |

OTHER PUBLICATIONS

International Search Report for PCT/IB2020/052392, 5 pages (dated Sep. 21, 2020).

(Continued)

*Primary Examiner* — Kenneth J Hansen

(74) *Attorney, Agent, or Firm* — Osha Bergman Watanabe & Burton LLP

(57) ABSTRACT

A pump assembly includes multiple impeller stages, each impeller stage including at least one impeller vane. At least one impeller stage includes at least one impeller vane with at least one perforation disposed therethrough.

23 Claims, 8 Drawing Sheets

(56) References Cited

U.S. PATENT DOCUMENTS

| | | | | |
|---|---|---|---|---|
| 9,353,614 | B2 | 5/2016 | Roth et al. | |
| 9,482,078 | B2 | 11/2016 | Carstensen et al. | |
| 10,370,947 | B1 | 8/2019 | Artinian et al. | |
| 2008/0199300 | A1 | 8/2008 | Eslinger | |
| 2012/0057965 | A1* | 3/2012 | Bergamini | F04D 31/00 415/143 |
| 2014/0178190 | A1* | 6/2014 | Gahlot | E21B 43/128 415/199.1 |
| 2015/0044027 | A1 | 2/2015 | Van Dam et al. | |
| 2016/0341206 | A1 | 11/2016 | Davis et al. | |
| 2021/0140289 | A1* | 5/2021 | Danger | F04D 15/0066 |

OTHER PUBLICATIONS

Written Opinion for PCT/IB2020/052392, 9 pages (dated Sep. 21, 2020).

* cited by examiner

ELECTRICAL SUBMERSIBLE PUMP WITH LIQUID-GAS HOMOGENIZER

FIELD

The subject matter described herein relates to apparatuses and systems for homogenizing fluids within electric submersible pumps.

BACKGROUND

Modern conventional electric submersible pumps (CESPs) are used for artificial lift in high production rate oil and gas installations at an estimated 200,000 wells worldwide. The electrical submersible centrifugal pumps are designed to pump liquid. When gas is present in the pumped fluid, the pump impeller vanes act as an efficient gas separator. The liquid phase is centrifuged by the impeller rotating motion due to its higher density, whereas the gas phase does not centrifuge, resulting in gas/liquid phase separation, with the liquid moving radially outward and the gas moving or remaining radially inward. As the impeller rotates, the pressure distribution between impeller vanes creates high-pressure and low-pressure areas, resulting in gas bubbles accumulating on the low-pressure side. If the amount of gas is not limited or if this type of pressure distribution is allowed to form, the vane cavities, (that is, the passage between the vanes) will eventually be filled with gas, thereby completely blocking the fluid passage. This scenario is known as "gas locking." The performance of a CESP severely deteriorates if the gas content increases with time. Eventually, the CESP fails to pump any volume of liquid at all, due to gas locking at a gas volume fractions (GVF) greater than 20%.

It is not uncommon for oil production from aging oil reservoirs to be accompanied by increasing gas content due to depleting reservoir pressure, which hinders the capabilities of CESPs from developing the total head (or hydrostatic pressure) required to produce a desired oil production rate at the surface. The deterioration of CESP performance starts to be appreciable for GVFs above 6%. For GVFs above 20%, the adverse performance effects on CESPs may be significant. Few attempts have been made to improve the impellers of conventional centrifugal pumps for pumping mixtures with high percentages of GVF. Gas-liquid separation within centrifugal electrical submersible pumps remains a common problem.

SUMMARY

The present disclosed embodiments include apparatuses, systems, and methods for homogenizing fluids within electrical submersible pumps (ESP) including perforations disposed within impellers for mixing gases and liquids within the ESPs.

In one aspect, the present invention is directed to a pump assembly including: multiple impeller stages, each impeller stage comprising an impeller vane, where at least one impeller stage includes an impeller vane with a perforation disposed therethrough.

In some embodiments, the liquid within the pump assembly flows from a first side of the impeller vane to a second side of the impeller vane via the perforation.

In some embodiments, the first side includes a convex surface of the impeller vane and the second side includes a concave surface of the impeller vane.

In some embodiments, the first side includes a pressure side of the impeller vane and the second side includes a suction side of the impeller vane.

In some embodiments, each impeller stage includes from about one (1) to about forty (40) impeller vanes.

In some embodiments, at least one impeller stage includes an impeller vane with from about one (1) to about twenty (20) perforations.

In some embodiments, at least one impeller stage includes an impeller vane with from about three (3) to about nine (9) perforations disposed therethrough.

In some embodiments, the perforation includes a cross-sectional area that is circular, elliptical, or cylindrical.

In some embodiments, the perforation includes a cross-sectional area that is square-shaped or rectangular.

In some embodiments, the perforation includes an aspect ratio from about two (2) to about five (5), where the aspect ratio is the ratio of a length of the perforation to a width of the perforation.

In some embodiments, the perforation includes an aspect ratio from about six (6) to about eight (8), where the aspect ratio is the ratio of a length of the perforation to a width of the perforation.

In some embodiments, the perforation is oriented such that a length of the perforation is aligned within about fifteen (15) degrees of a convex surface and a concave surface of the impeller vane.

In some embodiments, the perforation is oriented such that a length of the perforation is aligned within about fifteen (15) degrees of a direction that is perpendicular to a concave surface of the impeller vane.

In some embodiments, the impeller vane comprises a doublet, where the doublet includes two perforations disposed immediately adjacent to each other.

In some embodiments, the impeller vane includes a plurality of perforations and alternating perforations of the plurality of perforations are aligned along a top edge of a convex surface and a top edge of a concave surface of the impeller vane, respectively.

In some embodiments, the impeller vane includes a plurality of perforations and each perforation of the plurality of perforations is aligned along a convex surface of the impeller vane.

In some embodiments, the impeller vane includes a plurality of perforations and each perforation of the plurality of perforations is aligned along a concave surface of the impeller vane.

In some embodiments, at least one impeller stage includes: a first impeller vane including at least one perforation disposed therethrough; and a second impeller vane, where the second impeller vane is unperforated.

In another aspect, the present invention is directed to a pump assembly including: multiple impeller stages, where every third to every tenth impeller stage of the multiple impeller stages includes at least one perforated impeller vane.

In some embodiments, each impeller stage includes from about four (4) to about ten (10) impeller vanes, and at least one perforated impeller vane includes from about three (3) to about nine (9) perforations.

In another aspect, the present invention is directed to a pump assembly system including: a pump monitoring unit; an electric motor disposed above the pump monitoring unit and communicatively coupled thereto; a pump protector disposed above the electric motor; a pump intake disposed above the pump protector; and a pump module disposed above the pump intake and fluidly coupled thereto, the pump module mechanically coupled to the electric motor via at least one shaft disposed through each of the pump intake and the pump protector. The pump module includes at least one perforated impeller stage.

In some embodiments, the system includes an electric submersible pump (ESP) disposed within a borehole.

In some embodiments, at least one perforated impeller stage is disposed immediately downstream from the pump intake.

In some embodiments, fluid entering the pump assembly system at the pump intake includes a gas volume fraction (GVF) of 20% or higher.

It should be understood that the order of steps or order for performing certain action is immaterial as long as the invention remains operable. Moreover, two or more steps or actions may be conducted simultaneously.

The following description is for illustration and exemplification of the disclosure only, and is not intended to limit the invention to the specific embodiments described.

The mention herein of any publication, for example, in the Background section, is not an admission that the publication serves as prior art with respect to any of the present claims. The Background section is presented for purposes of clarity and is not meant as a description of prior art with respect to any claim.

BRIEF DESCRIPTION OF THE DRAWINGS

A full and enabling disclosure of the present disclosed embodiments, including the best mode thereof, directed to one of ordinary skill in the art, is set forth in the specification, which makes reference to the appended figures, in which.

DESCRIPTION OF CERTAIN EMBODIMENTS OF THE INVENTION

Figure 1:
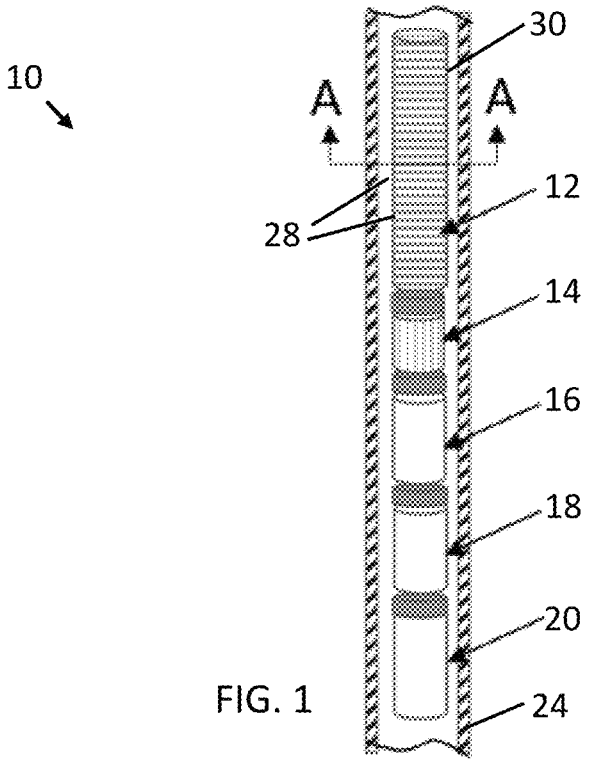
FIG. 1 illustrates a side view of an electrical submersible pump assembly, according to aspects of the present embodiments.

Reference will now be made in detail to the present disclosed embodiments, one or more examples of which are illustrated in the accompanying drawings. The detailed description uses numerical and/or letter designations to refer to features in the drawings. Like or similar designations in the drawings and description have been used to refer to like or similar parts of the present embodiments.

The present disclosed embodiments include apparatuses and systems for homogenizing liquid-gas mixtures within electrical submersible pumps including one or more impeller stages with at least one perforated impeller vane. The perforations disposed in the impeller vane fluidly connect a leading edge and trailing edge (or pressure side and suction side) of each impeller vane, allowing liquid to pass therethrough, thereby preventing gas lock and premature deterioration of the pump assembly, and components thereof.

The present disclosure uses impellers similar to those of a CESP, but also including one or more sets of holes or perforations in the impeller vanes. Liquid may flow from the high-pressure side of the vane to the low-pressure side, causing gas-liquid homogenization, thereby preventing gas accumulation on one side of the vane passage. The embodiments described herein may be easily implemented with minimal modification by retrofitting existing CESP systems.

FIG. 1 illustrates a schematic of an electric submersible pump (ESP) system 10 including a pump module 12 disposed above a pump intake 14. Fluids such as liquid hydrocarbons, gaseous hydrocarbons, water, water vapor, and other fluids may enter the pump assembly 10 via the pump intake 14, which may include one or more filters (not shown) to prevent sand, dirt, and other debris from entering the pump assembly 10. The pump module 12 may be coupled fluidly downstream of the pump intake 14, and may include a series of centrifugal impellers 28 and diffusers (not shown), each impeller 28 including one or more vanes 26 (shown in FIGS. 2-17). As such, the pump module may include a generally cylindrical shape or form factor. A pump protector 16 may be disposed below the pump intake 14 and may include seals, oil sumps, fluid pressurization features, thermal management features, and other features (such as electrical insulation) that help to protect the pump assembly 10 and components thereof from environmental hazards, and other potentially harmful conditions. An electrical motor 18 may be disposed below the pump protector 16 and may be used to mechanically rotate the pump impeller 28 stages via one or more shafts (not shown) disposed concentrically through the pump protector 16 and the pump intake 14. The shaft mechanically couples the electrical motor 18 to the pump module 12. The pump assembly 10 and components thereof may be disposed within a borehole 24, for example at a natural gas or oil drilling or production site. The pump assembly 10 may also include a pump monitoring unit 20 disposed beneath the electrical motor 18. The pump monitoring unit 20 may include sensors for monitoring the operation of the pump assembly 10, as well as a communications module for transmitting pump data to one or more electronic devices (not shown) located at the surface of the borehole 24 and/or formation.

Referring still to FIG. 1, the pump assembly 10 may also include a power delivery cable electrically coupling the pump assembly 10 to a surface power supply (not shown).

In operation, the pump may be used to lift well-fluids to the surface or to transfer fluids from one location to another. The electrical motor 18 provides the mechanical power required to drive the pump module 12 via the shaft. The power delivery cable provides a means of supplying the motor with the needed electrical power from the surface (or from a downhole power supply). The pump protector 16 may aid in absorbing the thrust load from the pump module 12, may transmit power from the electrical motor 18 to the pump module 12, may help to equalize pressure, may help provide and receive additional motor oil as the temperature changes, and may prevent well-fluid from entering the electric motor 18. The pump module 12 may include several stages, each stage being made up of at least one impeller 28 and at least one diffuser. The impellers 28, which rotate during operation, add energy to the fluid to provide head, whereas the diffusers, which are stationary, convert the kinetic energy of the fluid from the impellers 28 into head (that is, hydrostatic pressure). The pump stages may typically be stacked in series to form a multi-stage system that is contained within a pump housing 30. The aggregate or total hydrostatic pressure (that is, "head") generated by each individual stage is cumulative. Therefore, in one or more embodiments, the total head developed by the multi-stage system increases linearly from the first to the last stage. The pump monitoring unit 20 may be installed onto the electric motor 18 to measure parameters such as pump intake and discharge pressures, motor oil and winding temperatures, and vibrations. Measured downhole data may be communicated to the surface via the power cable, which may also act as a communication cable.

Figure 2:
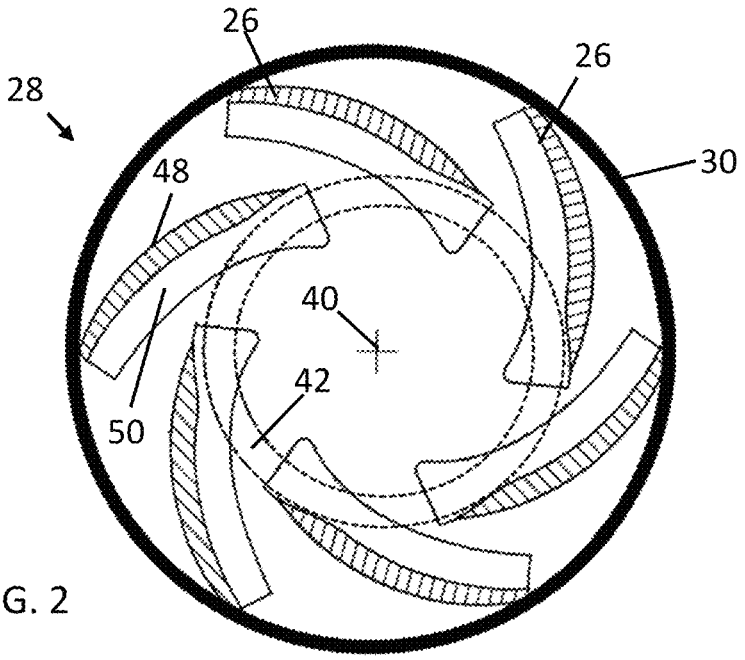
FIG. 2 illustrates a top view of an exemplary ESP impeller.

FIG. 2 illustrates a top view of an exemplary ESP impeller 28. The impeller 28 may be concentrically disposed about a longitudinal centerline 40. The pump housing 30 may extend circumferentially around the impeller 28. In addition, the impeller 28 may include a plurality of contoured impeller vanes 26. An annulus 42 may be disposed in the impeller 28. The annulus 42 may extend longitudinally from a pump stage located below the impeller illustrated in FIG. 2 such that the annulus 42 fluidly couples the impeller 28 to the stage located below it. The impeller vanes 26 illustrated in FIG. 2, regardless of the shape, contouring, orientations and angles, are solid (that is, without holes). Stated otherwise, the impeller vanes 26 illustrated in FIG. 2 are unperforated vanes. The convex side 48 of each impeller blade vane 26 is the high-pressure side, whereas the concave side 50 is the low-pressure side.

Figure 3:
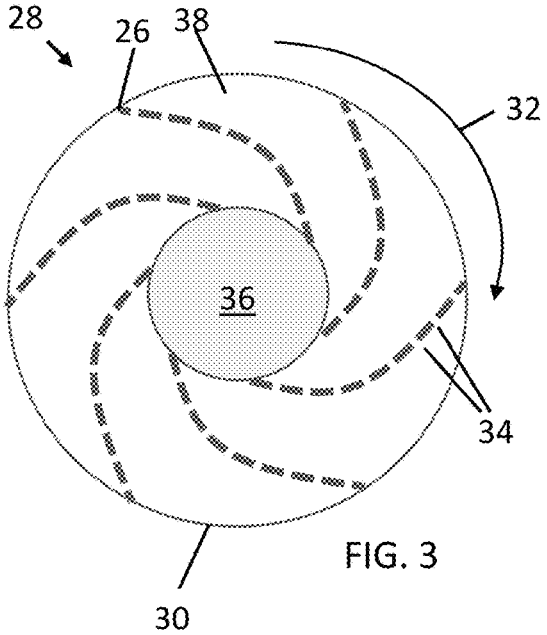
FIG. 3 illustrates a top view schematic of an ESP impeller, according to aspects of the present embodiments.

FIG. 3 illustrates a top view schematic of an ESP impeller 28 within a pump housing 30, according to aspects of the present embodiments. The impeller 28 may include one or more vanes 26 contoured to enhance the pressurization of fluid as it flows through the pump module 12. In the embodiments of FIGS. 2-4 and 6-17, six (6) impeller vanes 26 are illustrated. However, in other configurations of the impeller 28 according to the present disclosed embodiments, each impeller 28 may include anywhere from one (1) to about thirty (30) or forty (40) vanes 26. For example, each impeller 28 may include from about two (2) to about thirty (30) vanes 26, or from about three (3) to about twenty (20) vanes 26, or from about four (4) to about sixteen (16) vanes 26, or from about five (5) to about twelve (12) vanes 26, or from about six (6) to about ten (10) vanes 26, or about eight (8) vanes 26, or other sub-ranges therebetween. In other embodiments, each impeller 28 may include from about one (1) to about ten (10) impeller vanes 26, or from about three (3) to about eight (8) impeller vanes 26. Each of the vanes 26 may protrude vertically (or longitudinally) upward from an impeller plate 38. The vanes 26 may also include one or more perforations 34 (or holes) disposed therethrough to encourage the mixing and homogenization of gases and liquids within the pump assembly 10. The impeller plate 38 may be radially disposed around the shaft 36, which is longitudinally disposed through all of the impellers 28, and mechanically coupled thereto (thereby causing them to rotate as the shaft spins). In operation, each of the impellers 28 illustrated in FIGS. 2-4 and 5-17 rotate in a clockwise direction 32. In other embodiments, each of the impellers 28 illustrated in FIGS. 2-4 and 5-17 may be oppositely contoured and configured to rotate in a counterclockwise direction (not shown) rather than in a clockwise direction.

Figure 4:
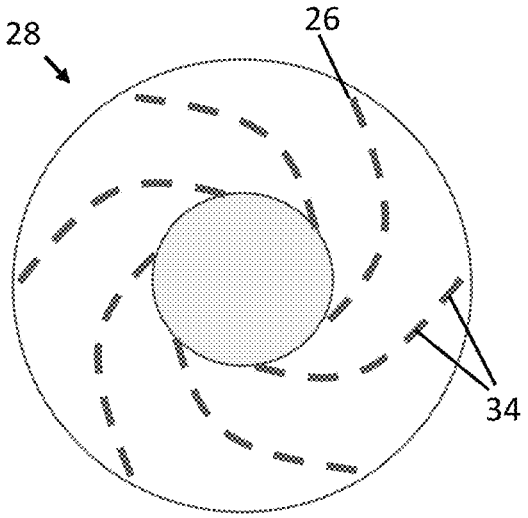
FIG. 4 illustrates a top view schematic of an ESP impeller, according to aspects of the present embodiments.

FIG. 4 illustrates a top view schematic of an ESP impeller 28, according to aspects of the present embodiments. In the embodiment of FIG. 4, the perforations 34 are more spread-out or spatially distributed as compared to the embodiment of FIG. 3. As a result, in the embodiment of FIG. 4, there are fewer perforations disposed with the vanes 26 than in the embodiment of FIG. 3. The annulus 42 is not shown in the schematics illustrated in FIGS. 3 and 4, but would nonetheless be present in impellers 28 according to the present embodiments. Each of the top views of FIGS. 2-4 and 6-17 may be taken along cut-line A-A shown in the side view of FIG. 1.

Figure 5:
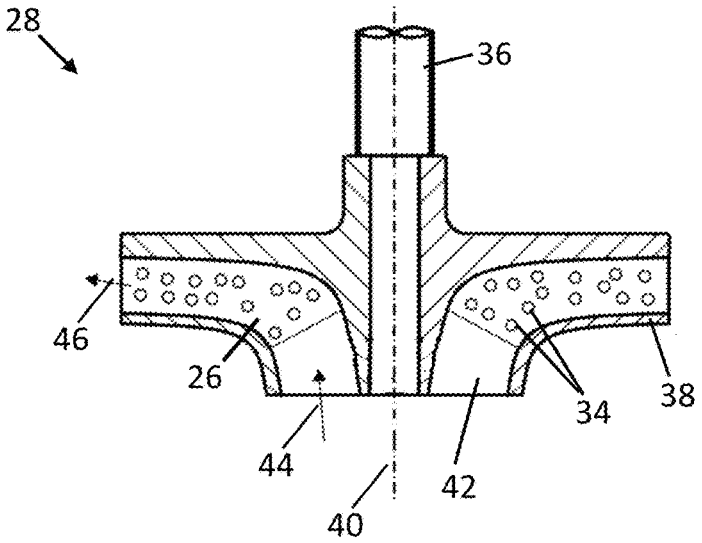
FIG. 5 illustrates a side view of an ESP impeller, according to aspects of the present embodiments.

FIG. 5 illustrates a side view of an ESP impeller 28, according to aspects of the present disclosed embodiments. The impeller 28 is disposed about the shaft 36, which in turn is concentrically disposed about the centerline 40. The annulus 42 extends generally longitudinally (that is, vertically) and fluidly couples to the impeller vane 26, or the impeller plate 38, or both the impeller vane 26 and the impeller plate 38. The impeller vane 26 may include a plurality of perforations 34 disposed therethrough. In the embodiment of FIG. 5, the perforations 34 are oriented in a random arrangement with no more than about two (2) or three (3) perforations disposed across the width of the impeller 28 at any one location. Also illustrated in FIG. 5 are both an inlet flow direction 44, which is in a generally longitudinal direction as fluid flows toward the impeller vane 26, and an outlet flow direction 46, which is in a generally radially outward direction as fluid is pushed radially outward by the impeller vanes 26. For example, the inlet flow direction 44 may be within about five (5), ten (10), or fifteen (15) degrees from the longitudinal direction while the outlet flow direction 46 may be within about five (5), ten (10), or fifteen (15) degrees from the radial direction. In other embodiments, (for example, in embodiments that include mixed-flow impellers) the outlet flow direction 46 may be within about twenty (20), twenty-five (25), thirty (30), or forty (40) degrees from the radial direction. Similarly, the orientation of the annulus 42 may be within about five (5), ten (10), or fifteen (15) degrees from the longitudinal direction while orientation of the impeller 28 may be within about five (5), ten (10), or fifteen (15) degrees from an orientation that is perpendicular to the longitudinal direction.

Referring to FIGS. 3-5, the first and subsequent stages of the pump assembly 10 may include different numbers of holes or perforations 34. For example, for every defined number of conventional stages (three (3), five (5), ten (10), twenty (20), etc.), there may be one stage with perforated vanes. This arrangement helps to ensure the fluid is well-mixed to attain homogeneity in all the stages throughout the pump assembly 10. In one embodiment, the stages of the pump assembly 10 may alternate between perforated and unperforated impellers 28. In another embodiment, every third impeller stage 28 may be perforated. In another embodiment, every fifth impeller stage 28 may be perforated. In another embodiment, every tenth impeller stage 28 may be perforated. In another embodiment, every twentieth impeller stage 28 may be perforated. In other embodiments according to the present disclosure, the pump assembly 10 may include other arrangements and spacings between perforated and unperforated impeller stages 28. In addition, multiple spacing arrangements may be employed in a single pump assembly 10. In another embodiment, a flow homogenizer (that is, a perforated impeller stage 28) may be installed upstream of the multistage pump assembly 10 followed by few more individual perforated impeller stages 28 at intermediate locations along the longitudinal length of the multistage pump assembly 10.

Referring still to FIGS. 3-5, the optimal intermediate location may vary based on the flow rate being pumped by the pump assembly 10, the mixture GVF, and the rated speed of the pump assembly 10. The optimal axial (or longitudinal) distance between perforated stages 28 may be determined from a combination of simulations and experiments. The homogenizing perforated stage or stages 28 not only smooth out the GVF fluctuations but may also dampen the kinetic energy of any liquid slugs that may occur, thereby minimizing potential damage to the pump internals. The homogenizing perforated stage or stages 28 may also be useful during production start-up operations to prevent the pump assembly 10 from running dry due to an initial accumulated gas pocket in the upper part of the well following a period of well-shut-in or inoperation. The numbers and arrangement of holes and perforations 34 throughout the impeller stages 28 of the pump assembly 10 may be varied, and the vane perforations 34 may take different shapes. For example, the perforations may be of equal sizes or different sizes, or even different distributions, as shown in FIGS. 6-17.

Figure 6:
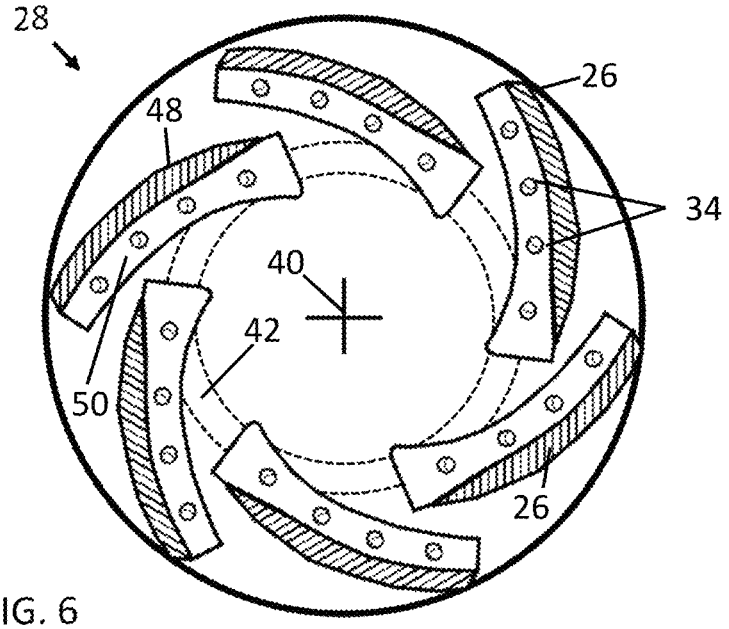
FIG. 6 illustrates a top view of an ESP impeller, according to aspects of the present embodiments.

FIG. 6 illustrates a top view of an ESP impeller 28, according to aspects of the present embodiments. In the embodiment of FIG. 6, each of the impellers 26 includes four (4) perforations 34 disposed therethrough. Each of the perforations 34 fluidly connects a suction side of each impeller vane 26 (that is, at the concave surface 50) to a pressure side of each impeller vane 26 (that is, at the convex surface 48) of each vane 26. Because both liquid and gaseous fluids may flow through the perforations, the impeller 28 of FIG. 6 allows for additional homogenization and mixing of gases and liquids, thereby reducing gas-liquid separation that occurs with conventional, unperforated impeller vanes 26 (for example, similar to those of FIG. 2). The centerlines 40 of the pump assembly 10, as well as the annulus 42 are also depicted in FIG. 6.

Figure 7:
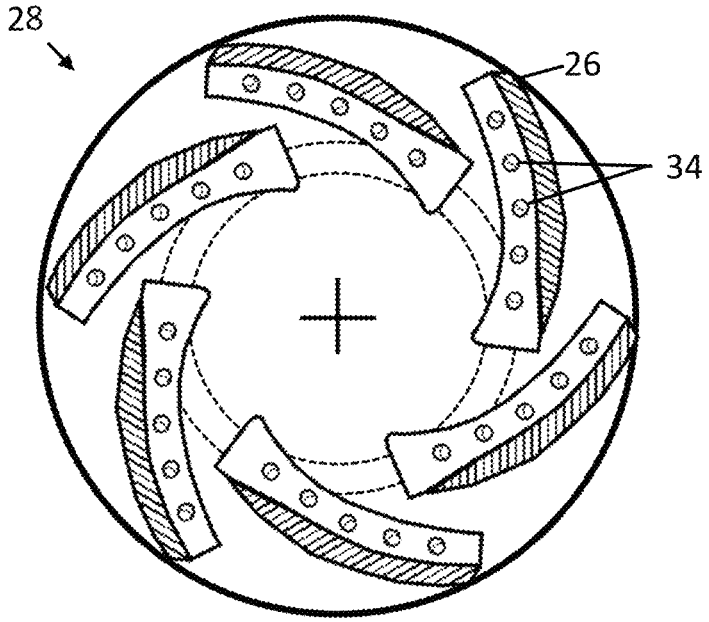
FIG. 7 illustrates a top view of an ESP impeller, according to aspects of the present embodiments.

FIG. 7 illustrates a top view of an ESP impeller 28, according to aspects of the present embodiments. In the embodiment of FIG. 7, each of the impeller vanes 26 includes five (5) perforations 34 disposed therethrough.

Figure 8:
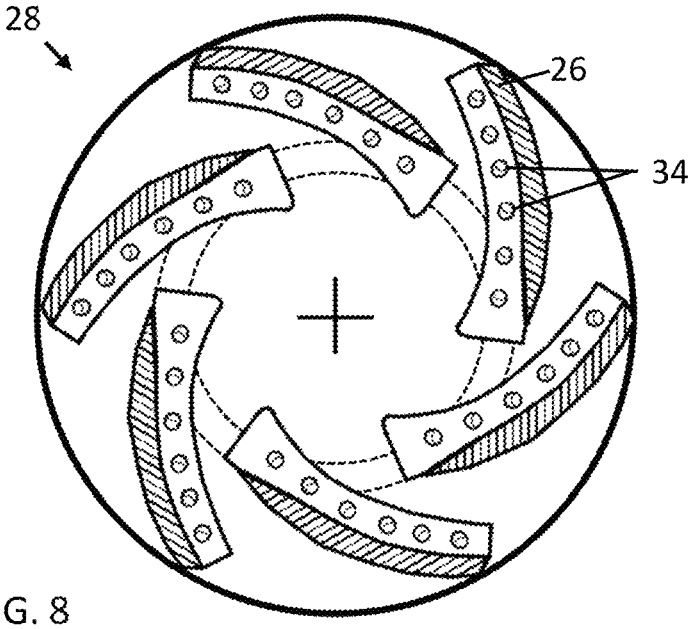
FIG. 8 illustrates a top view of an ESP impeller, according to aspects of the present embodiments.

FIG. 8 illustrates a top view of an ESP impeller 28, according to aspects of the present embodiments. In the embodiment of FIG. 8, each of the impeller vanes 26 includes six (6) perforations 34 disposed therethrough. In each of FIGS. 6-8, the impellers 28 may include one or more impeller vanes 26 with four (4) perforations 34, one or more impeller vanes 26 with five (5) perforations 34, one or more impeller vanes 26 with six (6) perforations 34, one or more impeller vanes 26 with another number of perforations 34 (such as 8, 10, 12, 14, 16, 18, 20, and more than 20), as well as various combinations thereof (including combinations which include one or more impeller vanes 26 with zero (0) perforations).

Figure 9:
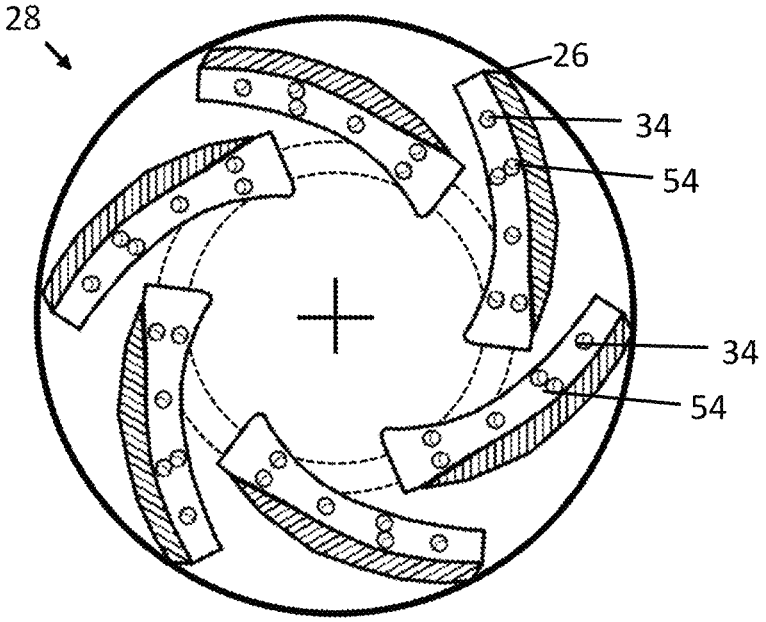
FIG. 9 illustrates a top view of an ESP impeller, according to aspects of the present embodiments.

FIG. 9 illustrates a top view of an ESP impeller 28, according to aspects of the present embodiments. In the embodiment of FIG. 9, each of the impeller vanes 26 includes one or more single perforations 34, as well as one or more doublets 54 (that is, two perforations disposed adjacent to one another, for example, immediately adjacent to each other). The single perforations 34 may alternate spatially with the doublets 54.

Figure 10:
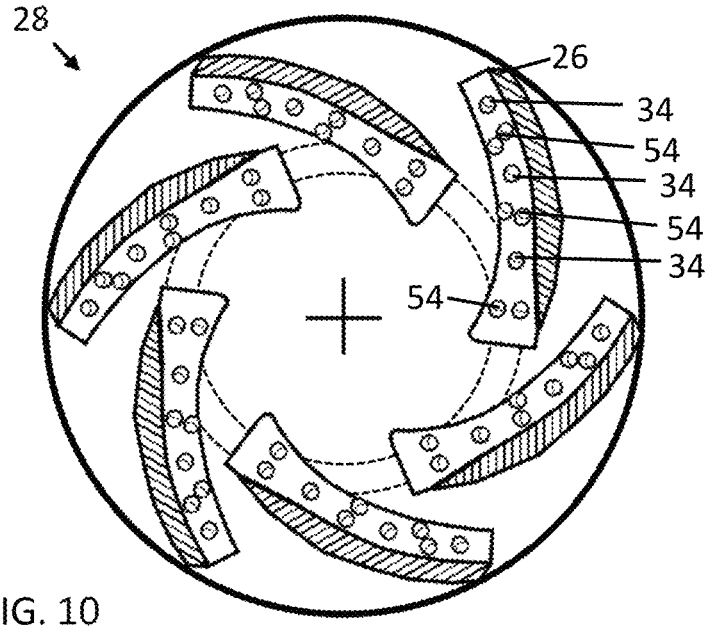
FIG. 10 illustrates a top view of an ESP impeller, according to aspects of the present embodiments.

FIG. 10 illustrates a top view of an ESP impeller 28, according to aspects of the present embodiments. In the embodiment of FIG. 10, each of the impeller vanes 26 includes one or more single perforations 34, as well as one or more doublets 54 (that is, two perforations disposed adjacent to one another, for example immediately adjacent to each other). The single perforations 34 may alternate spatially with the doublets 54. In the embodiment of FIG. 10, each impeller vane 26 includes three (3) single perforations 34 in an alternating arrangement with three (3) doublets 54. By contrast, in the embodiment of FIG. 9, each impeller vanes 26 includes two (2) single perforations 34 in an alternating arrangement with two (2) doublets 54.

Figure 11:
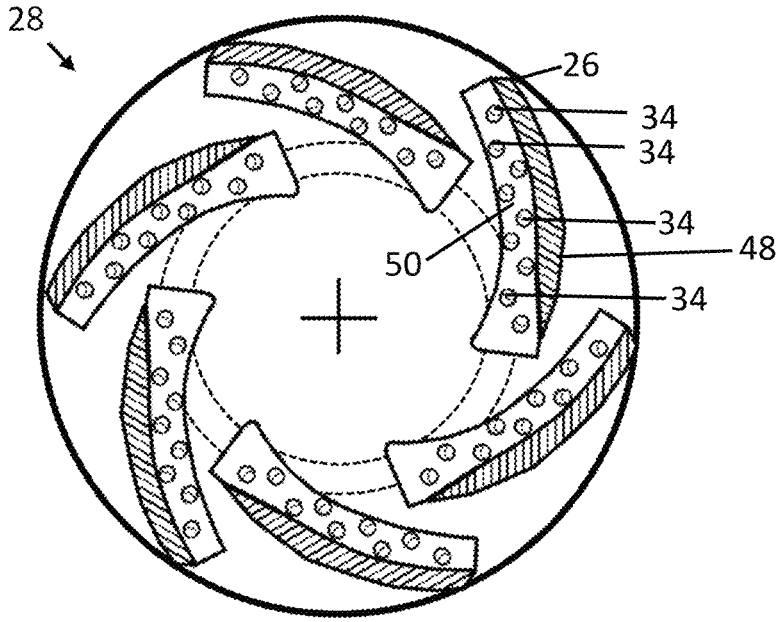
FIG. 11 illustrates a top view of an ESP impeller, according to aspects of the present embodiments.

FIG. 11 illustrates a top view of an ESP impeller 28, according to aspects of the present embodiments. In the embodiment of FIG. 11, each of the impeller vanes 26 includes a first plurality of single perforations 34 aligned along a convex surface 48 of the impeller vane 26 and a second plurality of single perforations 34 aligned along the concave surface 50 of the impeller vane 26. The single perforations 34 aligned along the convex surface 48 may alternate with the perforations 34 disposed within the concave surface 50.

Figure 12:
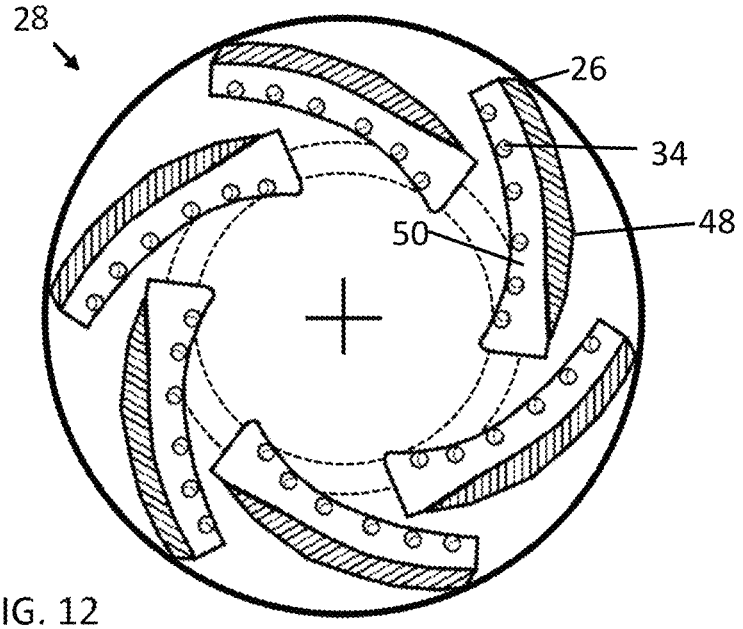
FIG. 12 illustrates a top view of an ESP impeller, according to aspects of the present embodiments.

FIG. 12 illustrates a top view of an ESP impeller 28, according to aspects of the present embodiments. In the embodiment of FIG. 12, each of the impeller vanes 26 includes a plurality of perforations 34 aligned along the bottom edges of surfaces 48 and 50 of the impeller vane 26.

Figure 13:
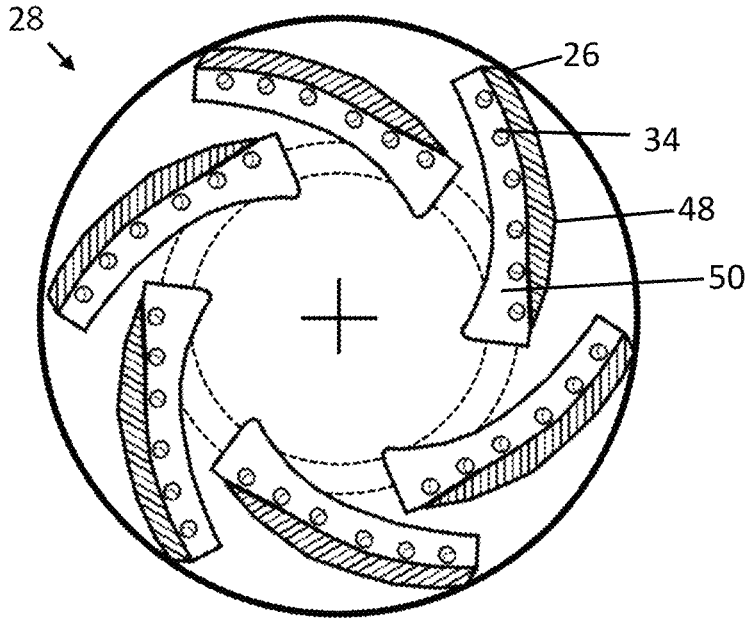
FIG. 13 illustrates a top view of an ESP impeller, according to aspects of the present embodiments.

FIG. 13 illustrates a top view of an ESP impeller 28, according to aspects of the present embodiments. In the embodiment of FIG. 13, each of the impeller vanes 26 includes a plurality of perforations 34 aligned along the top edges of surfaces 48 and 50 of the impeller vane 26. Each of the embodiments of FIGS. 5-13 may include circular perforations 34. Stated otherwise, each of the embodiments of FIGS. 5-13 may include substantially cylindrical perforations (that is, with circular cross-sectional areas). In other embodiments, each of the impeller vanes 26 of FIGS. 5-13 may include perforations 34 with elliptically, triangularly, rectangularly or other-shaped cross-sectional areas. In other embodiments, each of the impeller vanes 26 may include perforations 34 with square-shaped, rhombus-shaped, trapezoid-shaped, pentagon-shaped, hexagon-shaped, octagon-shaped, or other-shaped cross-sectional areas.

Figure 14:
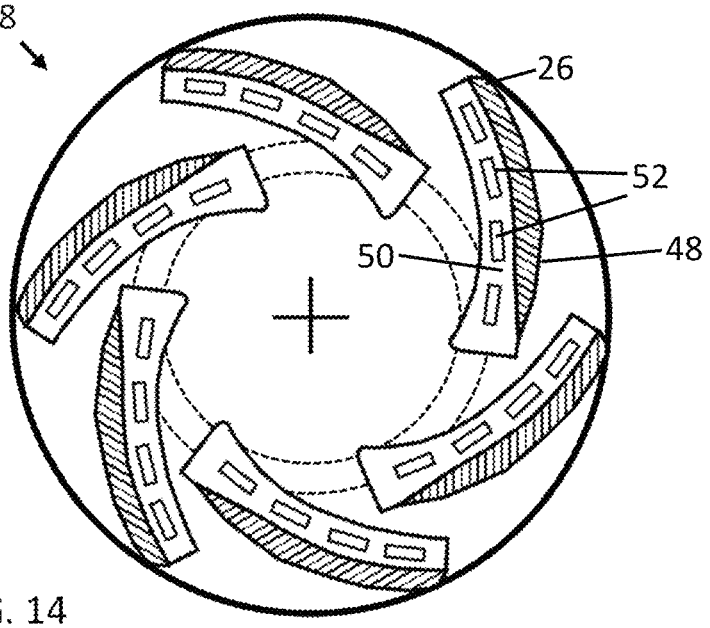
FIG. 14 illustrates a top view of an ESP impeller, according to aspects of the present embodiments.

FIG. 14 illustrates a top view of an ESP impeller 28, according to aspects of the present embodiments. In the embodiment of FIG. 14, each of the impeller vanes 26 includes four (4) rectangular perforations 52 oriented such that a length of each perforation 52 is substantially parallel with the convex surface 48, or the concave surface 50, or both the convex and concave surfaces 48, 50, respectively, of each impeller vane 26. For example, in one or more embodiments, the length of each rectangular perforation 52 may be aligned within about five (5) degrees, within about ten (10) degrees, or within about fifteen (15) degrees of at least one of the convex and concave surfaces 48, 50, respectively.

Figure 15:
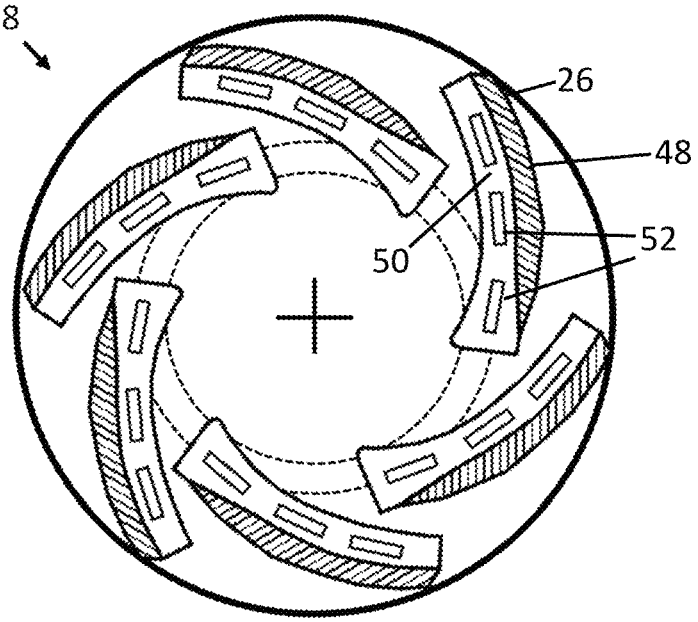
FIG. 15 illustrates a top view of an ESP impeller, according to aspects of the present embodiments.

FIG. 15 illustrates a top view of an ESP impeller 28, according to aspects of the present embodiments. In the embodiment of FIG. 15, each of the impeller vanes 26 includes three (3) rectangular perforations 52 oriented such that a length of each perforation 52 is substantially parallel with the convex surface 48, or the concave surface 50, or both the convex and concave surfaces 48, 50 of each impeller vane 26. For example, in one or more embodiments, the length of each rectangular perforation 52 may be aligned within about five (5) degrees, within about ten (10) degrees, or within about fifteen (15) degrees of at least one of the convex and concave surfaces 48, 50, respectively.

Figure 16:
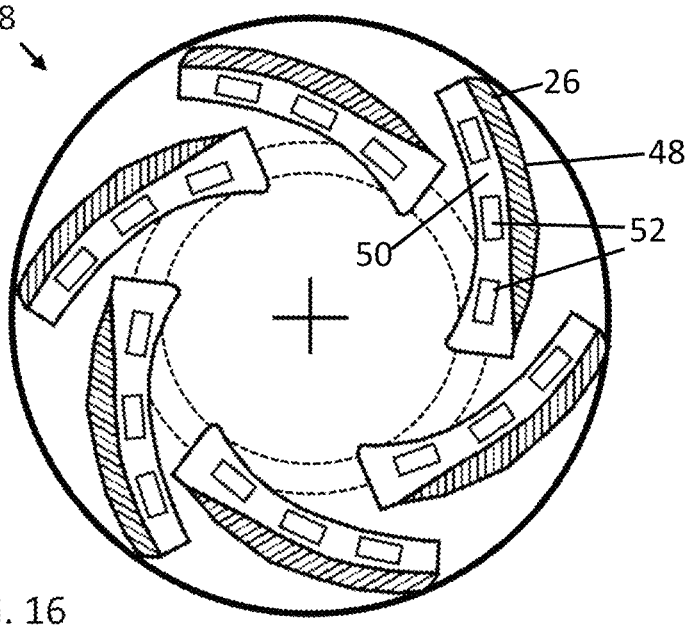
FIG. 16 illustrates a top view of an ESP impeller, according to aspects of the present embodiments.

FIG. 16 illustrates a top view of an ESP impeller 28, according to aspects of the present embodiments. In the embodiment of FIG. 16, each of the impeller vanes 26 includes three (3) rectangular perforations 52 oriented such that a length of each perforation 52 is substantially parallel with the convex surface 48, or the concave surface 50, or both the convex and concave surfaces 48, 50, respectively, of each impeller vane 26. For example, in one or more embodiments, the length of each rectangular perforation 52 may be aligned within about five (5) degrees, within about ten (10) degrees, or within about fifteen (15) degrees of at least one of the convex and concave surfaces 48, 50, respectively. In the embodiment of FIG. 16, the aspect ratio of each rectangular perforation 52 (that is, the ratio of the length to the width) may be from about one (1) or two (2) to about five (5) or from about three (3) to about four (4), as well as other subranges therebetween. By contrast, in the embodiments of FIGS. 14 and 15, the aspect ratio of each of the rectangular perforations 52 (that is, the ratio of the length to the width) may be from about four (4) to about ten (10), or from about five (5) to about nine (9), or from about six (6) to about eight (8), as well as other subranges therebetween. As such, each of the rectangular perforations of FIGS. 14-16 (as well as FIG. 17) may include an aspect ratio from about one (1) (that is, square-shaped) to about ten (10). In other embodiments, one or more of the rectangular perforations may include an aspect ratio greater than ten (10). Generally, the perforations in the embodiment of FIG. 16 may include a smaller aspect ratio than those of FIGS. 14, 15, and 17.

Figure 17:
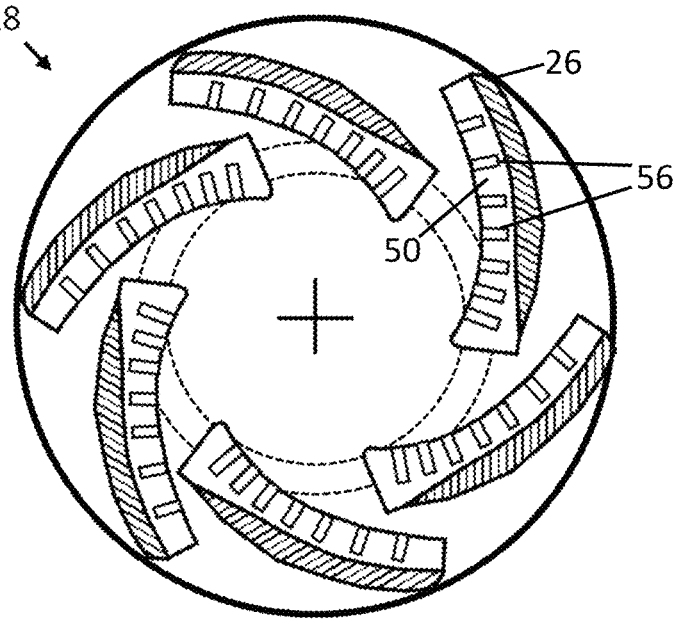
FIG. 17 illustrates a top view of an ESP impeller, according to aspects of the present embodiments.

FIG. 17 illustrates a top view of an ESP impeller 28, according to aspects of the present embodiments. In the embodiment of FIG. 17, each of the impeller vanes 26 includes seven (7) rectangular perforations 56 oriented such that a length of each perforation 56 is substantially perpendicular to the convex surface 50 of each impeller vane 26. For example, in one or more embodiments, the length of each rectangular perforation 56 may be aligned within about five (5) degrees, within about ten (10) degrees, or within about fifteen (15) degrees of a direction that is perpendicular to the top and bottom edges of concave surface 50 of each impeller vane 26 (that is, as defined at the intersection of each rectangular perforation 56 with the top and bottom edges of concave surface 50).

As previously discussed, each of the embodiments of FIGS. 2-4 and 6-17 include impellers 28 with six (6) impeller vanes 26. However, ESP impellers 28 according to the present disclosed embodiments may include other numbers of impeller vanes 26 including from about one (1) to about forty (40) and all subranges therebetween. For example, in some embodiments, each impeller stage 28 may have from about one (1) to about ten (10) impeller vanes 26 or from about three (3) to about eight (8) impeller vances 26. In addition, pump assemblies 10 according to the present disclosed embodiments may include impeller vanes 26 with more than one perforation arrangements (either within a single impeller 28, or one or more impeller stages 28 with different perforation orientations than at least one other impeller stage 28), according to any of the arrangements illustrated in FIGS. 2-4 and 6-17. In other embodiments, a single impeller stage 28 may include at least one perforated impeller vane 26 and at least one unperforated impeller vane 26. For example, in one embodiment, an impeller stage 28 may include six (6) impeller vanes 26 that alternate between perforated and unperforated impeller vanes 26.

The ESPs 10 of the present disclosed embodiments provide a low complexity, low cost and efficient homogenizer for use in downhole conventional electric submersible pump (CESP) applications for producing multiphase well fluids with high gas volume fractions (GVF). In operation, the liquid flows from the high pressure side of each impeller vane 26 to the low pressure side (or from the convex surface 48 to the concave surface 50) via the perforations, 34, 52, 54, 56, thereby causing gas-liquid homogenization and preventing accumulation of the gas on one side of each impeller vane 26. In some embodiments, the present flow homogenizer (that is, perforated impeller 28) has the same shape and size of a typical CESP pump stage, is driven by the same shaft, but is different in that it incorporates one or more impeller stages 28 with perforated impeller vanes 26. Incorporating the flow homogenizer 28 does not require installation of a gas handling unit upstream of the CESP. In some embodiments, the first perforated impeller stage 28 of the CESP acts as a flow homogenizer for the inlet mixture. For example, in one embodiment, the first impeller stage 28 of the pump assembly 10 (that is, the impeller stage immediately downstream from the pump intake 14) is a perforated impeller stage 28. In another embodiment, one or more intermediate flow homogenizer stages 28 may be installed at varied distances along the axial length of the CESP (for example after every group of three (3), five (5), ten (10), et cetera, pump stages) to ensure homogeneity of the liquid-gas mixture, and to prevent phase segregation (or separation) that may cause gas lock and related problems.

The present disclosure presents embodiments that maintain a homogeneous gas-liquid mixture over the entire length of the ESP pump assembly 10, thereby helping to prevent gas lock problems and other operational instabilities. The perforations 34, 52, 54, 56 may be machined into existing ESP impeller stages 28, or otherwise fabricated, or manufactured at low cost. The present disclosed embodiments may be retrofitted into existing CESPs, thereby eliminating the need to replace CESPs and other associated equipment and systems. As a result, the present disclosed embodiments may reduce the equipment failures and operational downtime by reducing or eliminating gas lock incidents. By selectively incorporating one or more impeller stages 28 with perforated impeller vanes 26 throughout the pump assembly 10, pump assemblies 10 according to the present embodiments may include an enhanced ability to accommodate a wide range of GVF applications by increasing or decreasing the number and spacing of intermediate homogenizer impeller stages 28. In addition, the present disclosed embodiments, which include one or more perforated impeller stages 28 interspersed throughout the several impeller stages 28, provide a benefit over systems that homogenize the fluid upstream of the pump assembly 10 since homogenized fluid may nonetheless be subject to gas-liquid separation as it flows through the pump assembly 10 and several impeller stages 28 thereof. In some embodiments, perforated impeller stages 28 may be incorporated into pump assemblies 10 in addition to the existing impeller stages 28 of each pump assembly 10. In other embodiments, perforated impeller stages 28 may be incorporated into pump assemblies 10 in place of one or more of the existing impeller stages 28 of each pump assembly 10.

Elements of different implementations described may be combined to form other implementations not specifically set forth previously. Elements may be left out of the processes described without adversely affecting their operation or the operation of the system in general. Furthermore, various separate elements may be combined into one or more individual elements to perform the functions described in this specification.

Other implementations not specifically described in this specification are also within the scope of the following claims.

These and other features, aspects and advantages of the present invention will become better understood with reference to the following description and appended claims. The accompanying drawings, which are incorporated in and constitute a part of this specification, illustrate embodiments of the present disclosure and, together with the description, serve to explain the principles of the present embodiments.

Certain Definitions

In order for the present disclosure to be more readily understood, certain terms are first defined below. Additional definitions for the following terms and other terms are set forth throughout the specification.

An apparatus, system, or method described herein as "comprising" one or more named elements or steps is open-ended, meaning that the named elements or steps are essential, but other elements or steps may be added within the scope of the apparatus, system, or method. To avoid prolixity, it is also understood that any apparatus, system, or method described as "comprising" (or which "comprises") one or more named elements or steps also describes the corresponding, more limited apparatus system, or method "consisting essentially of" (or which "consists essentially of") the same named elements or steps, meaning that the apparatus, system, or method includes the named essential elements or steps and may also include additional elements or steps that do not materially affect the basic and novel characteristic(s) of the system, apparatus, or method. It is also understood that any apparatus, system, or method described herein as "comprising" or "consisting essentially of" one or more named elements or steps also describes the corresponding, more limited, and closed-ended apparatus, system, or method "consisting of" (or "consists of") the named elements or steps to the exclusion of any other unnamed element or step. In any apparatus, system, or method disclosed herein, known or disclosed equivalents of any named essential element or step may be substituted for that element or step.

As used herein, the term "longitudinally" generally refers to the vertical direction, and may also refer to directions that are co-linear with or parallel to the centerlines 40 of the pump assembly 10, or borehole 24. Angles that are defined relative to a longitudinal direction may include both negative and positive angles. For example, a 30-degree angle relative to the longitudinal direction may include both an angle that is rotated clockwise 30 degrees from the vertical direction (that is, a positive 30-degree angle) as well as an angle that is rotated counterclockwise 30 degrees from the vertical direction (that is, a negative 30-degree angle).

As used herein, the term "gas volume fraction (GVF)" refers to the ratio of the gas volumetric flow rate to the total volumetric flow rate.

As used herein, "a" or "an" with reference to a claim feature means "one or more," or "at least one."

As used herein, the term "substantially" refers to the qualitative condition of exhibiting total or near-total extent or degree of a characteristic or property of interest.

EQUIVALENTS

It is to be understood that while the disclosure has been described in conjunction with the detailed description thereof, the foregoing description is intended to illustrate and not limit the scope of the invention(s). Other aspects, advantages, and modifications are within the scope of the claims.

This written description uses examples to disclose the invention, including the best mode, and also to enable any person skilled in the art to practice the present embodiments, including making and using any devices or systems and performing any incorporated methods. The patentable scope of the present embodiments is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A pump assembly comprising:

multiple impeller stages, where every third to every tenth impeller stage of the multiple impeller stages comprises at least one perforated impeller vane, where each of the multiple impeller stages comprises at least one unperforated impeller vane and at least one diffuser.

2. The assembly of claim 1, where each impeller stage comprises from four (4) to ten (10) impeller vanes, and where the at least one perforated impeller vane comprises from three (3) to nine (9) perforations.

3. The assembly of claim 1, where liquid within the pump assembly flows from a first side of the at least one perforated vane to a second side of the at least one perforated vane via at least one perforation.

4. The assembly of claim 3, where the first side comprises a convex surface and the second side comprises a concave surface.

5. The assembly of claim 3, where the first side comprises a pressure side and the second side comprises a suction side.

6. The assembly of claim 1, where each of the multiple impeller stages comprises from two (2) to forty (40) impeller vanes, wherein the impeller vanes alternate between perforated impeller vanes and unperforated impeller vanes.

7. The assembly of claim 1, where the at least one perforated impeller vane one (1) to twenty (20) perforations, and where the perforations comprise a cross-sectional area that is circular, elliptical, or cylindrical.

8. The assembly of claim 1, where the at least one perforated impeller vane includes three (3) to nine (9) perforations disposed therethrough.

9. The assembly of claim 3, where the perforation comprises a cross-sectional area that is square-shaped or rectangular.

10. The assembly of claim 9, where the perforation comprises an aspect ratio from two (2) to five (5), where the aspect ratio is the ratio of a length of the perforation to a width of the perforation.

11. The assembly of claim 9, where the perforation comprises an aspect ratio from six (6) to eight (8), where the aspect ratio is the ratio of a length of the perforation to a width of the perforation.

12. The assembly of claim 9, where the perforation is oriented such that a length of the perforation is aligned within fifteen (15) degrees of a convex surface and a concave surface of the at least one perforated impeller vane.

13. The assembly of claim 9, where the perforation is oriented such that a length of the perforation is aligned within fifteen (15) degrees of a direction that is perpendicular to at least one of a top edge and a bottom edge of at least one of a convex surface and a concave surface of the at least one perforated impeller vane.

14. The assembly of claim 1, where the at least one perforated impeller vane comprises a doublet, where the doublet comprises two perforations disposed immediately adjacent to each other.

15. The assembly of claim 9, where an inlet flow direction is oriented within fifteen (15) degrees of a longitudinal direction, and where an outlet flow direction is oriented with in fifteen (15) degrees of a radial direction.

16. The assembly of claim 1, where the at least one perforated impeller vane comprises a plurality of perforations and each perforation of the plurality of perforations is aligned along a concave surface of the at least one perforated impeller vane.

17. The assembly of claim 1, comprising an annulus disposed in at least one impeller stage of the multiple impeller stages and extending longitudinally from a pump stage located below the at least one impeller stage such that the annulus fluidly couples the at least one impeller stage to the pump stage located below it.

18. The assembly of claim 1, where each of the at least one perforated impeller vanes and the at least one unperforated impeller vanes protrudes longitudinally upward from an impeller plate.

19. A pump assembly system comprising:

a pump monitoring unit;

an electric motor disposed above the pump monitoring unit and communicatively coupled thereto;

a pump protector disposed above the electric motor;

a pump intake disposed above the pump protector; and a pump module disposed above the pump intake and fluidly coupled thereto, the pump module mechanically coupled to the electric motor via at least one shaft disposed through each of the pump intake and the pump protector, where the pump module comprises multiple impeller stages, where every third to tenth impeller stage of the multiple impeller stages comprises at least one perforated impeller vane, where each of the multiple impeller stages comprises at least one unperforated impeller vane and at least one diffuser, where the at least one perforated impeller vane comprises at least one perforation, and where a length of each perforation is substantially parallel to a convex surface, a concave surface, or both a convex surface and a concave surface of each impeller vane.

20. The system of claim 19, wherein the system is configured as an electric submersible pump (ESP) disposed within a borehole, and where the perforation comprises a cross-sectional area that is square-shaped or rectangular.

21. The system of claim 20, where the at least one perforated impeller vane is disposed immediately downstream from the pump intake, where an inlet flow direction is oriented within fifteen (15) degrees of a longitudinal direction, and where an outlet flow direction is oriented within fifteen (15) degrees of a radial direction.

22. The system of claim 21, where fluid entering the pump assembly system at the pump intake includes a gas volume fraction (GVF) of 20% or higher.

23. The system of claim 19, where each impeller stage comprises from four (4) to ten (10) impeller vanes, and where the at least one perforated impeller vane comprises from three (3) to nine (9) perforations.

* * * * *